United States Patent [19]

Doros

[11] Patent Number: 4,973,808

[45] Date of Patent: Nov. 27, 1990

[54] SWITCH BUTTERFLY ASSEMBLY

[75] Inventor: Jacek P. Doros, Chicago, Ill.

[73] Assignee: Illinois Tool Works, Inc., Glenview, Ill.

[21] Appl. No.: 355,190

[22] Filed: May 22, 1989

[51] Int. Cl.[5] ..... H01H 5/06

[52] U.S. Cl. ..... 200/448

[58] Field of Search ..... 200/448, 447, 449, 462–467, 200/6 R

[56] References Cited

U.S. PATENT DOCUMENTS 3,612,793 10/1971 Roeser ..... 200/448

*Primary Examiner*—Renee S. Luebke

*Attorney, Agent, or Firm*—Schwartz & Weinrieb

[57] ABSTRACT

A switch butterfly assembly for use in compact snap-action switches includes a pair of movable switch contact blade members, each being formed of a first end portion, a substantially flat mid-portion, and a second end portion all integrally joined together. The second end portion has a generally curvilinear-shaped configuration and is formed of a vertical section and a C-shaped curved blade section. The intermediate area of the C-shaped curved blade section is disposed opposite the vertical section so as to form an annular space therebetween. The vertical section has a first bend integrally connected to the mid-portion and a second bend integrally connected to the C-shaped curved blade section. The C-shaped section has an upper movable contact blade portion located outwardly from the second bend and a lower movable contact blade portion located outwardly from the free end thereof so as to reduce the stresses created upon the movable contact portions and thus increasing the useful service life of the butterfly assembly.

17 Claims, 1 Drawing Sheet

SWITCH BUTTERFLY ASSEMBLY

FIELD OF THE INVENTION

This invention relates generally to compact electrical switches and more particularly, it relates to an improved butterfly assembly which is used as a snap action mechanism in butterfly-type snap switches.

BACKGROUND OF THE INVENTION

Tn U.S. Pat. No 3,612,793 issued on Oct. 12, 1971, to John O. Roeser and entitled "Electrical Switch Components And Switches Formed Thereby," there is shown and described a unitary combination switchblade and contact means For compact switch mechanisms. As can be seen from FIGS. 8, 9 and 10 of the '793 patent, the combination switchblade and contact means 16 comprises a pair of identical members 109*a* (109*b*) each being formed of a first end portion 110 a mid-portion 116 and a curvilinear second end portion 118. The first end portion 110 consists of a pair of spaced apart legs 112 and 114. The legs are spaced apart by a dimension D so as to receive therebetween a tension spring 120, as illustrated in FIG. 5. A combination strut and attachment means 124 is shear formed in the curvilinear second end portion 118 and includes a reverse curve portion 131 for mating with the end of the tension spring 120 (FIG. 5).

The curvilinear second end portion 118 further includes an upper contact portion 128 and a lower contact portion 130 which is separated from the upper contact portion 128 by means of the reverse curve portion 131. The legs 112 and 114 are provided with sharpened edges 132 for pivoting within opposed V-shaped notch portions 106 formed within an elongated metal member 74 of the actuating means 114. The lower contact portion 130 is located within the same plane as the first portion 110 and the mid-portion 116 However, the upper contact portion 128 is off-set from that same plane. The lower and 15 upper contact portions 128 and 130 define movable contact members which are adapted to be snapped between opposed fixed contact portions upon upper terminal members 134 and lower terminal members 136, as illustrated in FIG. 5.

The upper portions of the upper terminal members 134 are formed with an off-set transverse portion 116 having a depending upper fixed contact 148 (FIGS. 14 and 15). The upper fixed contacts 148 serve to make electrical contact engagement with the upper contact portions 128 of the movable contact members. The lower terminal members 136 are provided with portions 156 which serve as lower fixed contacts for electrical contact engagement with lower contact portions 130 of the movable contact members.

The combination switchblade and contact means 16 is assembled with other components so as to form a compact precision, snap-action push-button switch 10 and is illustrated in FIGS. 2, 5 and 6. In operation, when the button 72 of the actuator means 14 is depressed so as to move downwardly, this causes the elongated metal member 74 to also more downwardly against the bias of the return springs 76 and 78. Initially, the combination 15 switchblade and contact means is restrained by means of the lower fixed contact portions 156 so that the lower contact portions 130 of the movable contact members remain in contact therewith.

This contact continues until the pivot points 106 pass the center line of the tension spring 120. At that time, the movable contact members will snap overcenter and the upper contact portions 130 thereof will become engaged with the upper fixed contacts 148. This engagement continues until such time when the pressure upon the top of the button 72 is released, thereby causing the return springs 76 and 78 to return the metal member 74 and button 72 to their rest positions shown in FIGS. 1 and 2. As the metal member 74 returns past the center line of the tension spring 120, the movable contact members will snap overcenter again in the reverse direction.

The present invention represents an improvement over the combination switchblade and contact means described above in connection with the '793 patent. The upper contact portion 128 and the lower contact portion 130 upon the second end portion 118 of the switchblade and contact means 16 in the aforenoted patent experience a high degree of stress during the switching operations which tends to shorten the service lives of such components. It would therefore be desirable to provide a novel and improved switch butterfly assembly for use in precision snap action switches which has a unique configuration so as to reduce the stresses upon the movable contact portions, thereby prolonging the service lives thereof.

OBJECTS OF THE INVENTION

Accordingly, it is a general object of the present invention to provide a novel and improved switch butterfly assembly for use with a snap-action switch mechanism which is relatively simple and economical to manufacture and assemble, but yet overcomes the disadvantages encountered in the prior art snap-action switches.

It is an object of the present invention to provide a switch butterfly assembly for use within a snap-action switch which is of a simple construction and thus is less costly to manufacture.

It is another object of the present invention to provide a switch butterfly assembly for use with a snap-action switch which reduces the stresses upon the movable contact portions and thus increases the useful service lives thereof.

It is still another object of the present invention to provide a switch butterfly assembly for use within a snap-action switch which includes a pair of movable switch contact blade members, each being formed so as to have a unique configuration.

In accordance with these aims and objectives, the present invention is concerned with the provision of a switch butterfly assembly for use within compact snap-action switches which includes a pair of movable switch contact blade members. Each blade member is formed of a single piece of electrically conductive material and consists of a first end portion, a substantially flat main portion, and a second end portion all integrally joined together. The First end portion is formed of a pair of spaced apart legs. Each leg has a sharpened edge at its outermost end to serve as a pivot point. The second end portion has a generally curvilinear-shaped configuration and is formed of a vertical section and a C-shaped curved blade section. The intermediate area of the C-shaped curved blade portion is disposed opposite the vertical section so as to form an annular space therebetween.

The vertical section has a first bend integrally connected to the main portion and a second bend integrally connected to the C-shaped curved blade section the vertical section has a small opening formed between the first and second bends for retaining one end of a tension spring. The free end of the C-shaped curved blade section is bent so as to be located substantially opposite the first bend and spaced apart therefrom so as to form a gap therebetween. The C-shaped curved blade section has an upper movable contact portion located outwardly from the second bend and a lower movable contact portion located outwardly from its free end thereof so as to reduce the stresses created upon the movable contact portions, thereby increasing the useful life of operation of the butterfly assembly.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout the several views and wherein.

DESCRIPTION OF THE PREFERRED EMBODIMENT

Figure 3:
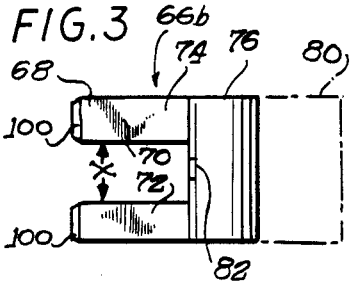
FIG. 3 is a top plan view of the movable switch contact blade structure of the butterfly assembly of FIG. 1 in an enlarged form.
Figure 1:
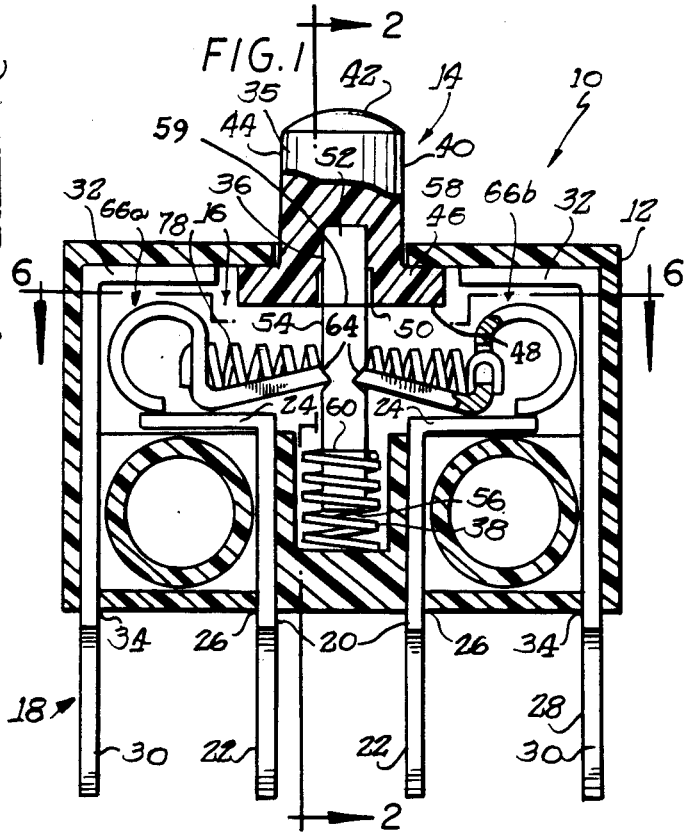
FIG. 1 is an enlarged, cross-sectional view of a single-pole, double-throw snap-action switch incorporating the improved switch butterfly assembly of the present invention.
Figure 2:
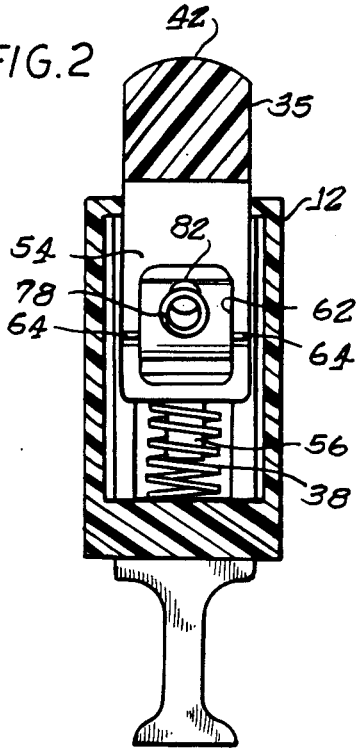
FIG. 2 is a cross-sectional view of the switch of FIG. 1, taken along the lines 2—2 of FIG. 1, with the butterfly assembly removed.

Referring now in detail to the various views of the drawings and in particular to FIGS. 1 through 3, there is shown a compact precision push-button switch 10 of the single-pole, double-throw type (two circuit switch) which comprises an outer protective housing 12, button and spring actuator assembly 14, an improved switch butterfly assembly 16 of the present invention, and terminal means 18. The outer housing 12 is preferably formed of a plastic material and has a generally rectangular configuration. The housing 12 serves to encase the actuator assembly 14, the butterfly assembly 16, and the terminal means 18 of the switch 10.

The terminal means 18 are operatively mounted within the outer housing 12. The terminal means 18 includes a pair of lower L-shaped terminal members 20, each formed of a vertical portion 22 and a horizontal portion 24. The vertical portions 22 extend through the bottom of the housing 12 through means of apertures 26. Furthermore, the terminal means 18 includes a pair of upper L-shaped terminal members 28 each formed of a vertical portion 30 and a horizontal portion 32. The Vertical portions 30 extend through the bottom of the housing 12 through means of apertures 34. The horizontal portions 24 of the lower terminal members 20 serve as lower fixed contacts, and the horizontal portions 32 of the upper terminal members 28 serve as upper fixed contacts.

The button and spring actuator assembly 14 includes a button member 35 formed of a molded plastic material. an elongated metal actuating member 36, and a return spring 38. The return spring 38 functions to return the button member 35 and the metal actuating member 36 to their original at rest positions illustrated in FIGS. 1 and 2. The button member 35 includes an upper cylindrical exterior portion 40 having a top 42 which is adapted to be manually engaged, cylindrical depending sidewalls 44 extending into the housing 12, and an enlarged bottom flange portion 46. A bottom surface 48 of the bottom flange portion 46 is formed with a central opening 50 for receipt of the metal actuating member 36.

The metal actuating member 36 has a generally rectangular-shaped configuration and is disposed along the vertical axis of switch 10. The metal member 36 is formed of a reduced-width top portion 52, an enlarged mid-portion 54, and a reduced-width bottom portion 56 as best seen in FIg. 2, and it is noted that although the actual reduced width dimension of top portion 52 is not illustrated, it is in fact similar to bottom portion 56. The reduced-width top portion 52 is provided with a t©p 58 which engages the top of the central aperture 50 in the button member 35 The enlarged mid-portion 54 is connected to the top portion 52 by means of an upper shoulder 59 The enlarged mid-portion 54 is oonnected to the bottom portion 56 by means of a lower shoulder 60. The bottom portion 56 is disposed loosely within one end of the return spring 38 which biases the metal member 36 and the button member 35 In an upward direction. The other end of the return spring 38 engages a bottom surface of the housing :2.

The mid-portion 54 further includes a central, through aperture 62 which is formed in its intermediate area, and which aperture has a substantially rectangular configuration with rounded corners. Two pairs of opposed V-shaped notch portions 64 are formed upon opposite sides of the aperture 62 and upon opposite faces of the mid-portion 54. The V-shaped notch portions 64 function as pivot points and as precision locations for the improved switch butterfly assembly 16. It should be noted that the upper shoulders 59 engage the bottom surface 48 of the button member 35. Furthermore, the notched portions 64 are located substantially mid-way between the top and bottom portions of the aperture 62.

The actuator assembly 14 mounts the improved switch butterfly assembly 16 and initiates the snap action thereof so as to provide selective switching connections between the upper fixed contacts and the lower fixed contacts. The switch butterfly assembly includes a pair of identical movable switch contact blade members **66*a* and 66*b*. Each of the contact blade members 66*a*, 66*b*** is preferably formed in a unitary integral manner from relatively sturdy sheet stock of a single piece in a stamping type forming operation. The blade members are formed preferably of a material having a silver inlay.

Figure 4:
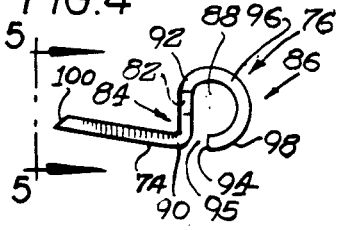
FIG. 4 is a side elevational view of the movable switch contact blade structure of FIG. 3.
Figure 5:
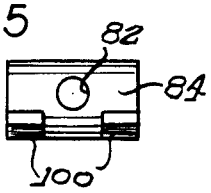
FIG. 5 is an end view of the movable switch contact blade structure of FIG. 3, taken along the lines 5—5 of FIg. 4.
Figure 6:
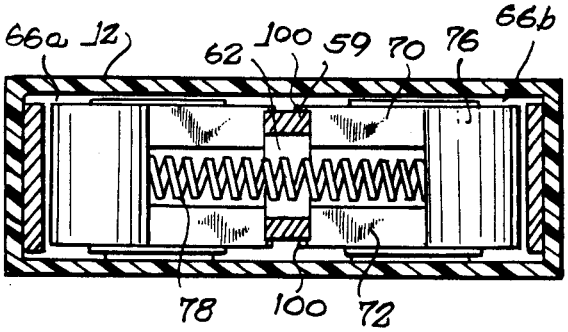
FIG. 6 is a cross-sectional view of the switch butterfly assembly, taken along the lines 6–6 of FIG. 1.

The movable contact blade member **66*b* of the butterfly assembly 16 is shown in FIGS. 3, 4 and 5 in the unassembled condition. In FIG. 1, the butterfly assembly 16 has been assembled into the housing 12. In FIG. 6, there is illustrated a top cross-sectional view of the butterfly assembly 16 of the switch 10. The movable switch contact blade member 66*b* is analogous to one of the butterfly "wings" and includes a first end portion 68 formed of a pair of laterally spaced apart legs 70 and 72, a substantially flat mid-portion or main portion 74, and a generally curvilinear-shaped second end portion 76. The legs 70 and 72 are spaced apart a dimension X which is slightly greater than the diameter of a tension spring 78 which passes therebetween as can best be seen in FIGS. 2 and 6. The tension spring 78 is made of a conventional stainless steel material which is initially blanked out of strip stock. The second end portion 76 is initially flat as shown by means of the phantom lines 80**.

As depicted in FIG. 3, a small opening 82 is formed within the plane 80 when it is still flat prior to curling of the second end portion to the curvilinear cylindrical shape 76 shown in FIG. 4. The small opening 82 is used to retain one end of the tension spring 78. As viewed from FIG. 4. It will be noted that the second end portion 76 is formed of a vertical section 84 and a C-shaped curved blade section 86. The intermediate area of the C-shaped section 86 is located opposite the vertical section 84 so as to form an annular space 88 therebetween. The vertical section 84 has a first bend 90 which is connected integrally to the mid-portion 74 and has a second bend 92 which is connected integrally to the C-shaped section 86. The free end 94 of the C-shaped section 86 is bent so as to be located substantially opposite the first bend 90 and is spaced apart therefrom so as to form a gap 95 therebetween. As can be seen in FIG. 5, the small opening 82 is formed in vertical section 84 between the first bend 90 and the second bend 92.

It will be noted that the C-shaped section 86 separates upper movable contact blade portion 96 and lower movable contact blade portion 98 which are in substantially vertical alignment. The upper contact blade portion 96 is located outwardly away from the second bend 92, and the lower contact blade portion 98 is located outwardly away from the free end 94 so as to reduce the stresses created on the contact blade portions 96 and 98, thereby increasing the useful life of the butterfly assembly 16 and thus the operation of the switch 10. The second end portion 76 has its lateral edge portions substantially aligned with the outboard edges of the spaced legs 70 and 72. The outermost ends of legs 70 and 72 are provided with sharpened edges 100 which are received within the notched portions 64 so as to create precision pivot points.

Furthermore, the tension spring 78 passes through the aperture 62 of the metal actuating member 36 so as to mount the pair of opposed movable switch contact blade members **66*a* and 66*b* in the opposed V-shaped notch portions 64. The opposed contact members 66*a* and 66*b* forming the switch butterfly assembly 16 are adapted to have their upper movable contact blade portions 96 and lower movable contact blade portions 98 thereon be snapped between the opposed fixed contact portions 32 on the upper terminal members 28 and the opposed fixed contact portions 24 on the lower terminal members 20**.

In the rest position, the contact blade members **66*a* and 66*b* are in bridging engagement between the lower terminal members 20 and the metal actuating member 46 is in its uppermost vertical position, as shown in FIG. 1. Thus, a circuit is completed between the two lower terminal members 20. In operation, the button member 35 of the actuator assembly 14 is depressed so as to cause the actuating member 36 to move downwardly against the bias of the return spring 38. Initially, the butterfly assembly 16 is restrained by means of the opposed fixed contact portions 24 upon the lower terminal members 20 and remain in contact therewith until the pivot points 64 pass the center line of the tension spring 78. At that time, the movable contact blade members 66*a* and 66*b* are then snapped overcenter so that the contact portions 96 engage the opposed fixed contact portions 32 on the upper terminal members 28**.

As a result, a circuit is now completed between the two upper terminal members 28. This engagement will continue until the downward pressure on the button member 34 is released causing the return spring 38 to return the butterfly assembly 16 back to the rest position shown in FIG. 1. As the pivot points 64 on the actuating member 36 move past the center line of the tension spring 78, the movable contact blade members **66*a* and 66*b*** will again be snapped overcenter but in the reverse direction.

From the foregoing detailed description, it can thus be seen that the present invention provides an improved butterfly assembly which has a unique configuration so as to reduce the stress upon the movable contact portions, thereby prolonging the useful life thereof. The butterfly assembly includes a pair of movable switch contact blade members each formed of a first end portion, a substantially flat mid-portion, and a second end portion all integrally joined together. The second end portion includes a vertical section and a C-shaped curved blade section. The vertical section has a first bend connected integrally to the mid-portion and has a second bend connected integrally to the C-shaped curved blade section. The C-shaped curved blade section is provided with an upper movable contact blade portion which is located outwardly from the second bend and a lower movable contact blade portion located outwardly from the free end thereof.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made so as to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A switch including a switch butterfly assembly for use in compact snap-action switches, said switch butterfly assembly comprising:

a pair of movable switch contact blade members, each member being formed of a single piece of electrically conductive material;

each member being further formed of a first end portion, a substantially flat mid-portion, and a second end portion all integrally joined together;

said first end portion being formed of a pair of spaced apart legs, each leg having a sharpened edge at its outermost end to serve as a pivot point;

said second end portion having a generally curvilinear-shaped configuration and being formed of a vertical section and a C-shaped curved blade section, said C-shaped curved blade section having its intermediate area disposed opposite said vertical section so as to form an annular space therebetween;

said mid-portion being integrally connected only to said vertical section by means of a first bend section formed at one end of said vertical section, and said C-shaped curved blade section being integrally connected only to said vertical section by means of a second bend section formed at a second end of said vertical section, said vertical section having a small opening formed between said first and second bends for retaining one end of a tension spring;

said C-shaped curved blade section having its free end bent so as to be located substantially opposite said first bend and spaced apart from said first bend so as to form a gap therebetween; and said C-shaped curved blade section having an upper movable contact blade portion outwardly from said second bend, and a lower movable contact blade portion located outwardly from said free end thereof, whereby stresses created upon said movable contact blade portions are reduced so as to increase the useful service life of said butterfly assembly.

2. A switch butterfly assembly as claimed in claim 1, wherein each of said movable contact blade members are formed of a material having a silver inlay.

3. A switch as set forth in claim 1, wherein:

said first and second bend sections comprise oppositely extending bend sections with respect to each other.

4. A switch as set forth in claim 1, further comprising:

upper and lower fixed terminal members for electrically cooperating with said movable switch contact blade members so as to define first and second electrical circuits therewith.

each one of said upper and lower fixed terminal members comprising a substantially L-shaped terminal member having a short leg and a long leg, said short legs being disposed in vertically overlapping, spaced-apart modes for defining contact positions engageable by said movable switch contact blade members so as to complete said first and second electrical circuits.

5. A switch as set forth in claim 1, further comprising:

actuating means for pivotably mounting said sharpened edge portions of said movable switch contact blade members; and aperture means defined through said actuating means for accommodating said tension spring interconnecting said vertical sections of said movable switch contact blade members.

6. A switch as set forth in claim 5, wherein:

said tension spring is interposed between said spaced apart legs of said first end portions of said movable switch contact blade members.

7. A switch as set forth in claim 5, further comprising:

notch means formed upon opposite sides of said actuating means, and upon opposite sides of said through-aperture, for accommodating said sharpened edge pivot points of said movable switch contact blade members.

8. A compact snap-action switch, comprising:

housing means;

actuating means disposed within said housing means for movement inwardly from a first position to a second position;

return spring means disposed within said housing and connected to said actuating means for returning said actuating means from said second position to said first position when pressure is released upon said actuating means;

a switch butterfly assembly disposed within said housing and being pivotally mounted upon said actuating means;

said butterfly assembly including a pair of movable switch contact blade members, each member being formed of a single piece of electrically conductive material;

each member being further formed of a first end portion, a substantially flat mid-portion, and a second end portion all integrally joined together;

said first end portion being formed of a pair of spaced apart legs, each leg having a sharpened edge at its outermost end so as to serve as a pivot point;

said second end portion having a generally curvilinear-shaped configuration and being formed of a vertical section and a C-shaped curved blade section, said C-shaped curved blade section having its intermediate area disposed opposite said vertical section so as to form an annular space therebetween;

said mid-portion being integrally connected only to said vertical section by means of a first bend section formed at one end of said vertical section, and said C-shaped curved blade section being integrally connected only to said vertical section by means of a second bend section formed at a second end of said vertical section, said vertical section having a small opening formed between said first and second bends for retaining one end of a tension spring;

said C-shaped curved blade section having its free end bent so as to be located substantially opposite said first bend and spaced apart from said first bend so as to form a gap therebetween; and said C-shaped curved blade section having an upper movable contact blade portion located outwardly from said second bend, and a lower movable contact blade portion located outwardly from said free end thereof, whereby stresses created upon said movable contact blade portions are reduced so as to increase the useful service life of said butterfly assembly.

9. A compact snap-action switch as claimed in claim 8, wherein each of said movable contact blade members are formed of a material having a silver inlay.

10. A switch as set forth in claim 8, wherein:

said first and second bend sections comprise oppositely extending bend sections with respect to each other.

11. A switch as set forth in claim 8, further comprising:

aperture means defined through said actuating means for accommodating said tension spring so as to interconnect said vertical sections of said movable switch contact blade members.

12. A switch as set forth in claim 11, wherein:

said tension spring is interposed between said spaced apart legs of said first end portions of said movable switch contact blade members.

13. A switch as set forth in claim 11, further comprising:

notch means formed upon opposite sides of said actuating means, and upon opposite sides of said through-aperture, for accommodating said sharpened edge pivot points of said movable switch contact blade members.

14. A compact snap-action switch as claimed in claim 8, wherein said housing means is provided with a plurality of openings and wherein upper and lower fixed terminal members are mounted in said housing means to extend through said openings.

15. A switch as set forth in claim 14, wherein:

each one of said upper and lower fixed terminal members comprises a substantially L-shaped terminal member having a short leg and a long leg; said short legs of said terminal members being disposed in a vertically overlapping, spaced apart mode for defining contact positions engageable by said movable switch contact blade members when said actuating means is moved between said first and second positions.

16. A compact snap-action switch as claimed in claim 14, wherein said movable switch contact blade members bridge said lower fixed terminal members in the first position to provide a completed circuit therethrough.

17. A compact snap-action swItch as claimed in claim 16, wherein said movable switch contact blade members bridge said upper fixed terminal members in the second position to provide a second completed circuit therethrough.

* * * * *